US007770509B2

(12) United States Patent
Kennedy et al.

(10) Patent No.: US 7,770,509 B2
(45) Date of Patent: Aug. 10, 2010

(54) VALVE CAP

(75) Inventors: George Coulter Kennedy, Renfrewshire (GB); Guillaume Sourdois, Renfrewshire (GB)

(73) Assignee: Spicket Valves and Pumps Limited, Renfrewshire (GB)

( * ) Notice: Subject to any disclaimer, the term of this patent is extended or adjusted under 35 U.S.C. 154(b) by 776 days.

(21) Appl. No.: 11/568,911

(22) PCT Filed: May 4, 2005

(86) PCT No.: PCT/GB2005/001673

§ 371 (c)(1),
(2), (4) Date: Mar. 6, 2007

(87) PCT Pub. No.: WO2005/108790

PCT Pub. Date: Nov. 17, 2005

(65) Prior Publication Data

US 2008/0093361 A1 Apr. 24, 2008

(30) Foreign Application Priority Data

May 10, 2004 (GB) ..... 0410263.8

(51) Int. Cl.
*F04B 53/00* (2006.01)
*F01B 29/00* (2006.01)

(52) U.S. Cl. ..... 92/128; 417/454

(58) Field of Classification Search ..... 92/128; 417/454, 539

See application file for complete search history.

(56) References Cited

U.S. PATENT DOCUMENTS 3,327,643 A 6/1967 Pangburn
3,435,777 A 4/1969 Schaaf
4,516,477 A * 5/1985 Lewis et al. ..... 92/128
6,209,445 B1 4/2001 Roberts, Jr. et al.

FOREIGN PATENT DOCUMENTS

GB 2306607 5/1997

OTHER PUBLICATIONS

Southwest Oilfield Products, Inc. website extract; Quick Change Valve Covers; ca. 2002; available at http://www.swoil.com/assemblies.htm.

P-QUIP website extract; Kwik-Clamp Valve & Strainer Cover Retention System; ca. 1999; available at http://www.pquip.com/uk/home1.html.

* cited by examiner

*Primary Examiner*—Thomas E Lazo
(74) *Attorney, Agent, or Firm*—Daniel N. Lundeen; Lundeen & Lundeen, PLLC

(57) ABSTRACT

There is disclosed a valve cap for sealing an aperture in a pump; a plugging assembly for use in a valve cap to provide a seal at an aperture in a pump; a docking unit for use with a plugging assembly for sealing an aperture in a pump; and a method of sealing an aperture in a pump. In an embodiment of the invention, a valve cap (10) for sealing an aperture (12) in a pump is disclosed which comprises a valve plug (16) for locating against a wall (18) of the aperture, the plug including, a first engaging means (40); a compression unit (20) fastened to the pump, the compression unit including a plurality of springs (56) to apply a compressive load upon the plug and second engaging means (62, 64); a docking unit (24) for landing on the compression unit, the docking unit including one or more pistons (92) to apply a compressive load upon said springs and third engaging means (74, 76, 78); wherein said first and third engaging means sequentially interlock with said second engaging means to lock said plug to said compression unit and seal said plug against said aperture.

55 Claims, 4 Drawing Sheets

VALVE CAP

The present invention relates to valve caps and in particular, though not exclusively, to a valve cap for use on a hole in a mud-pump fluid-end module.

In the oil industry mud pumps are used to pump viscous fluids, such as drilling muds, cement, or other well fluids. Although mud pumps may be either centrifugal or reciprocating type pumps, typically mud pumps are reciprocating pumps using one or more pistons and hydraulic cylinders with liners to generate the high pressures required to pump these viscous fluids in and out of the well.

Mud pumps include a fluid end and a power end. At the fluid end, low pressure fluid is drawn in and built-up by compression via a pump piston and check valves, until the pressure overcomes well bore pressure so as to pump the mud into the well. The power end contains the gears that reciprocate the pump piston. It will be appreciated that parts within the pump exposed to the fluid and its associated pressure are liable to wear easily. In particular sufficient seals need to be provided at unused inlets/outlets and at the valves.

These seal covers are typically referred to as valve caps or valve covers. They must provide a seal while closing off the aperture of an end piece at the fluid end of the pump.

FIG. 1 shows a prior art valve cap A for use with a pump as supplied by Southwest Oilfield Products, Inc, Houston, Tex., USA. A valve plug B is located against a step in the aperture C of an end piece D. A seal E is provided between the parts. The seal is maintained by pressure from a cap body F located against it. The body F is screwed in place through a locking member G attached to the end piece D at an end face H. Once located the locking member G is forced against the end face H by using a stud rods J and retention nuts K,L as is known in the art. This movement is transferred to the body F via the screw threads and effectively locks the body F against the plug B. When the cap A needs to be removed the nuts K,L are released and a steel bar is inserted through a guide hole M in the body F and turned to remove the body F and release the plug B.

A disadvantage of this valve cap is in the use of threaded connections. It is difficult to determine if the threads are correctly tightened. During mud pump operation, the reciprocating nature and peak pump pressures acts on any insufficiently tightened connections, resulting in a tendency for the valve cap to gradually loosen. Alternatively, the threaded connections have been over tightened, making it even more difficult to unthread. Additionally, in using a steel bar it is often necessary to hammer the bar to release the cap. Such activity is obviously dangerous. In some regions of the world local laws prohibit the use of sledge hammers for personnel safety reasons.

To overcome these problems a spring based retaining valve cap has been developed. This valve cap is illustrated in FIG. 2 and is supplied by P-Quip Ltd., Linwood, Scotland. Like parts to those of FIG. 1 have been given the same reference. In this cap, the body F is forcibly pushed against the plug B by a number of piston and spring arrangements located in the locking member G. The member G is initially bolted to the end piece D at the face H by bolts M. Each arrangement comprises a cylinder N adapted to house a slidable piston P and clamping springs Q. The piston P has a threaded rod R extending outwith the cylinder N and through the body F. A retaining nut K is located on the threaded rod R. In use, the cap is assembled as shown in FIG. 2 with the nuts K on the threaded rods R. Hydraulic fluid is then inserted between the piston P and the cylinder base, such that the piston P is extended to a greater extent outwith the cylinder N and the nut K is tightened further against the body F. The hydraulic pressure is then released and the springs Q apply their force to the plug B through the rods R, the nuts K and the body F.

A disadvantage of this cap is in the large dimensions of the cap and the respective face on the end piece required. This is because the space must be available both for bolts to connect the locking member to the end piece, and for the cylinders in which the pistons are housed. As a result these caps are generally limited to a maximum of four cylinders which has the disadvantage of causing an uneven pressure to be applied to the body.

It is an object of the present invention to provide a valve cap which uses a spring clamping force to hold a plug within an aperture of a fluid end of a pump.

It is a further object of the present invention to provide a valve cup in which a distributed compressive force is applied to the plug.

According to a first aspect of the present invention there is provided a valve cap for sealing an aperture in a pump, the cap comprising:

a valve plug for locating against a wall of the aperture, the plug including a first engaging means;

a compression unit fastened to said pump, the compression unit including a plurality of springs to apply a compressive load upon the plug and second engaging means;

a docking unit for landing on the compression unit, the docking unit including one or more pistons to apply a compressive load upon said springs and third engaging means;

wherein said first and third engaging means sequentially interlock with said second engaging means to lock said plug to said compression unit and seal said plug against said aperture.

By locking the compression unit to the plug, the docking unit can be removed to be used on any number of compression units and plug combinations. Additionally as the pistons are independent of the springs, a large number of springs can be used to distribute load on the plug without the need to find space for the pistons. The large number of springs also allows maximum uplift on the plug (due to mud pressure incl. peak pressures) to be fully restrained.

Preferably said engaging means comprises one or more keyed profiles. Preferably the first and third engaging means comprise cogs. Advantageously the second engaging means comprises a cylindrical surface on which is arranged internally facing teeth. The teeth may match teeth on the cogs. Preferably also two rows of teeth are provided on the compression unit such that a cog can pass one row of teeth and by rotation be interlocked between the rows of teeth.

Preferably the plug further comprises upper and lower members. Preferably also the plug includes a first seal arranged around an outer surface of the plug.

Advantageously the first seal is tapered. Preferably also there is a second seal between the members. Preferably the plug includes an elongate member arranged parallel to a base of the plug. The elongate member may be used to engage a tool for turning the plug within the aperture.

Preferably the compression unit further comprises an upper plate and a lower plate, the plates sandwiching the plurality of springs. Preferably also fastening means is provided through each plate to attach the plates to the pump. Advantageously the fastening means are stud rods, each passing through a spring and including a retaining nut at one end. Preferably the lower plate comprises the second engaging means.

Preferably the docking unit further comprises a stem, the stem having a longitudinal bore therethrough for access to the plug, a locating plate including a plurality of recesses for locating on the fastening means and one or more cylinders, the/each cylinder including a piston, the piston extending from the cylinder to impact a tensioning disc located on the stem. Preferably the third engaging means is located at a lower end of the stem. Preferably a locking nut is located on the stem adjacent the tensioning disc. Advantageously there are one or more ports through which hydraulic fluid can enter the one or more cylinders. Preferably an upper end of the stem includes a pair of radially aligned apertures through which a bar may be passed to rotate the stem.

Preferably the valve cap further comprises a locking tool, the locking tool being used to interlock the first engaging means to the second engaging means. Preferably the locking tool comprises a barrel suitable for locating through the stem and a hook arranged to engage the elongate member.

According to a second aspect of the present invention there is provided a plugging assembly for use in a valve cap to provide a seal at an aperture in a pump, the assembly comprising:

a valve plug for locating against a wall of the aperture, the plug including a first engaging means;

a compression unit fastened to said pump, the compression unit including a plurality of springs to apply a compressive load upon the plug and second engaging means;

wherein said first and second engaging means interlock when the springs are in full compression and remain locked when the springs are released.

Preferably said engaging means comprises one or more keyed profiles. Preferably the first engaging means comprise cogs. Advantageously the second engaging means comprises a cylindrical surface on which is arranged internally facing teeth. The teeth may match teeth on the cogs. Preferably also two rows of teeth are provided on the compression unit such that a cog can pass one row of teeth and by rotation be interlocked between the rows of teeth.

Preferably the plug further comprises upper and lower members. Preferably the members are joined together. Preferably also the plug includes a first seal arranged around an outer surface of the plug. Advantageously the first seal is tapered. Preferably also there is a second seal between the members. Preferably the plug includes an elongate member arranged parallel to a base of the plug. The elongate member may be used to engage a tool for turning the plug within the aperture.

Preferably the compression unit further comprises an upper plate and a lower plate, the plates sandwiching the plurality of springs and the upper plate including a plurality of surfaces on which a compressive load can be applied. Preferably also fastening means is provided through each plate to attach the plates to the pump.

Advantageously the fastening means are stud rods, each passing through a spring and including a retaining nut at one end. Preferably the lower plate comprises the second engaging means.

According to a third aspect of the present invention there is provided a docking unit for use with a plugging assembly for sealing an aperture in a pump, the unit comprising:

a plurality of surfaces for landing on a compression unit of a plugging assembly;

one or more pistons to apply a compressive load upon said compression unit and third engaging means;

wherein said third engaging means interlocks with second engaging means of said compression unit during compression of said unit.

Preferably said engaging means comprises one or more keyed profiles. Preferably the third engaging means comprise cogs. Advantageously the second engaging means comprises a cylindrical surface on which is arranged internally facing teeth. The teeth may match teeth on the cogs. Preferably also two rows of teeth are provided on the compression unit such that a cog can pass one row of teeth and by rotation be interlocked between the rows of teeth.

Preferably the docking unit further comprises a stem, the stem having a longitudinal bore therethrough for access to the plug, a locating plate including a plurality of recesses for locating on the fastening means and one or more cylinders, the/each cylinder including a piston, the piston extending from the cylinder to impact a tensioning disc located on the stem. Preferably the third engaging means is located at a lower end of the stem. Preferably a locking nut is located on the stem adjacent the tensioning disc. Advantageously there are one or more ports through which hydraulic fluid can enter the one or more cylinders. Preferably an upper end of the stem includes a pair of radially aligned apertures through which a bar may be passed to rotate the stem.

Preferably the docking unit further comprises a locking tool, the locking tool being used to interlock a first engaging means of the plugging assembly to the second engaging means. Preferably the locking tool comprises a barrel suitable for locating through the stem and a hook arranged to engage the elongate member.

According to a fourth aspect of the present invention there is provided a method of sealing an aperture in a pump, the method comprising the steps:

(a) locating a valve plug against a wall of the aperture;

(b) fixing a compression unit to an end face of the pump around the aperture;

(c) landing a docking unit on the compression unit;

(d) by rotating a portion of the docking unit, locking the docking unit to the compression unit;

(e) applying a compressive load from the docking unit on the compression unit to compress a plurality of springs within the compression unit;

(f) tightening a plate over the compressed springs;

(g) locking the valve plug to the compression unit by rotating the valve plug; and (h) removing the docking unit and thereby removing the compressive load.

Preferably the valve plug, compression unit and docking unit are according to the first aspect.

An embodiment of the present invention will now be described, by way of example only, with reference to the following Figures of which:

Figure 1:
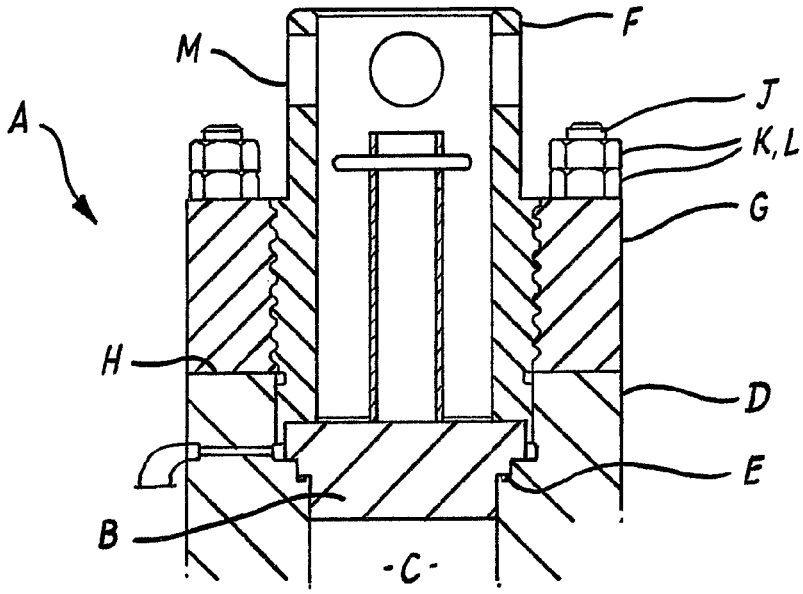
FIG. 1 (Prior Art)
FIG. 1 is a cross-sectional view through a prior art screw-type valve cap.
Figure 2:
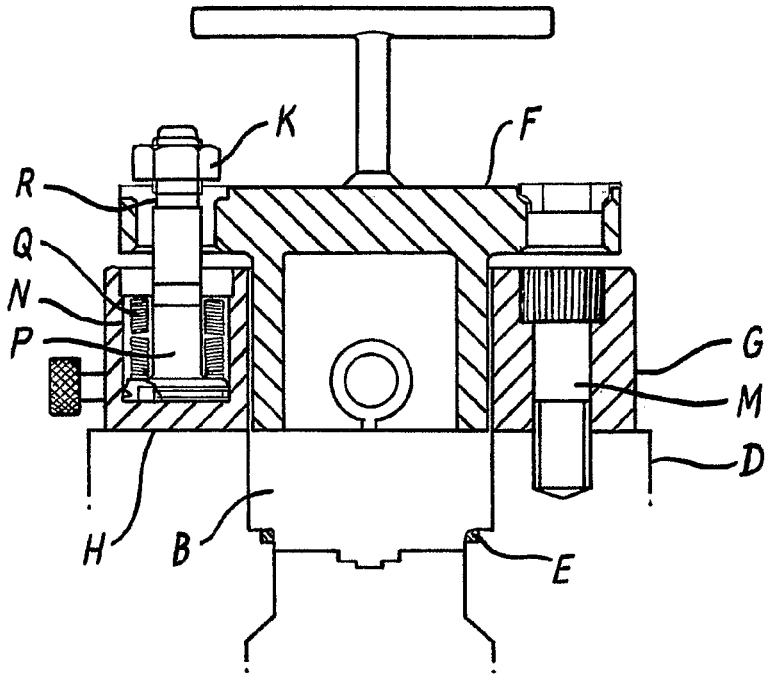
FIG. 2 (Prior Art)
FIG. 2 is a cross-sectional view through a prior art spring-over-piston type valve cap.
Figure 3:
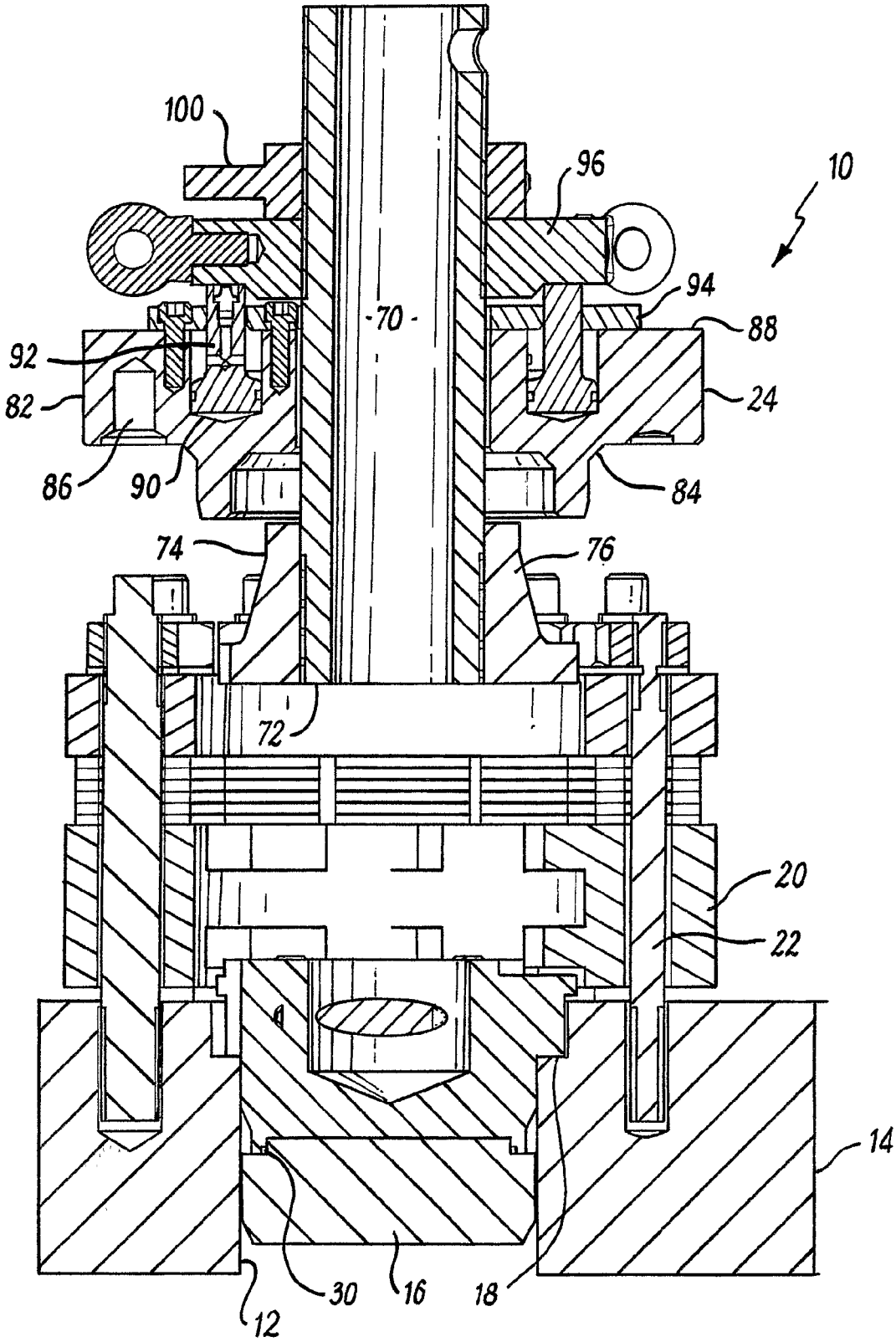
FIG. 3 is a cross-sectional view through a valve cap according to an embodiment of the present invention.

Reference is initially made to FIG. 3 of the drawings which illustrates a valve cap, generally indicated by reference numeral 10, according to an embodiment of the present invention. Valve cap 10 is used for sealing an aperture 12 at a fluid end 14 of a pump. Cap comprises a valve plug 16 which locates against a wall 18 of the aperture 12, a compression unit 20 which is fastened to the end 14 via stud rods 22 and a docking unit 24 for landing on the compression unit.

Figure 4:
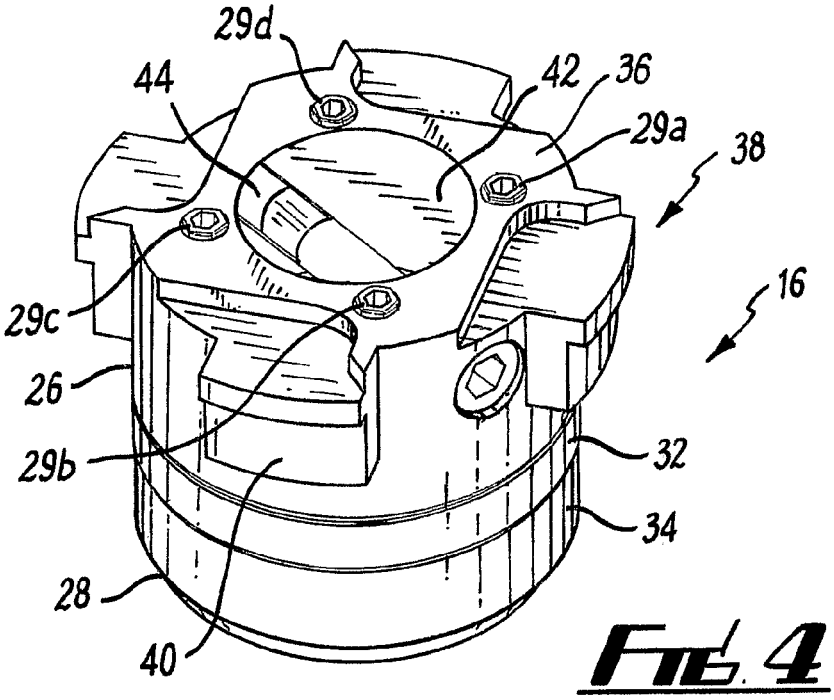
FIG. 4 is a plan view of a valve plug of the valve cap of FIG. 3.

Reference is now made to FIG. 4 of the drawings which illustrates the valve plug 16 in greater detail. Plug 16 comprises a two part cylindrical body having upper body 26 and a lower body 28. The bodies 26,28 are bolted together via bolts 29*a-d* and a seal 30 is provided at the join to prevent the ingress of fluid there between. At the join is also located a plug seal 32 which is arranged longitudinally on an outer surface 34 of the plug 16.

An upper end of the outer surface 34 together with a top surface 36 provides a keyed profile, generally indicated by reference numeral 38. The keyed profile 38 comprises four extensions or lugs 40*a-d* equidistantly spaced around the outer surface 34. Each extension 40 has a longitudinally arranged portion which meets a step, that is a protrusion radially outwards from the outer surface 34. Above the step is a planar top surface 36 on which is arranged a raised profile having four teeth extending outwards to the step with each meeting a side of the extension. From an apex of each tooth a longitudinally aligned sweeping surface, perpendicular to the top surface 36, provides a shelf above each protrusion. Each of the four sweeping surfaces meets the outer surface 34 at an end opposite the apex. The lugs 40 upon the surfaces 34,36 can be considered to comprise a cog.

On the top surface 36 there is further a central recess 42 into the upper body 26. At an upper end of the recess 42, but located totally within the recess 42 is a bar 44. Bar 44 is cylindrical and located off-centre to the recess 42.

Figure 5:
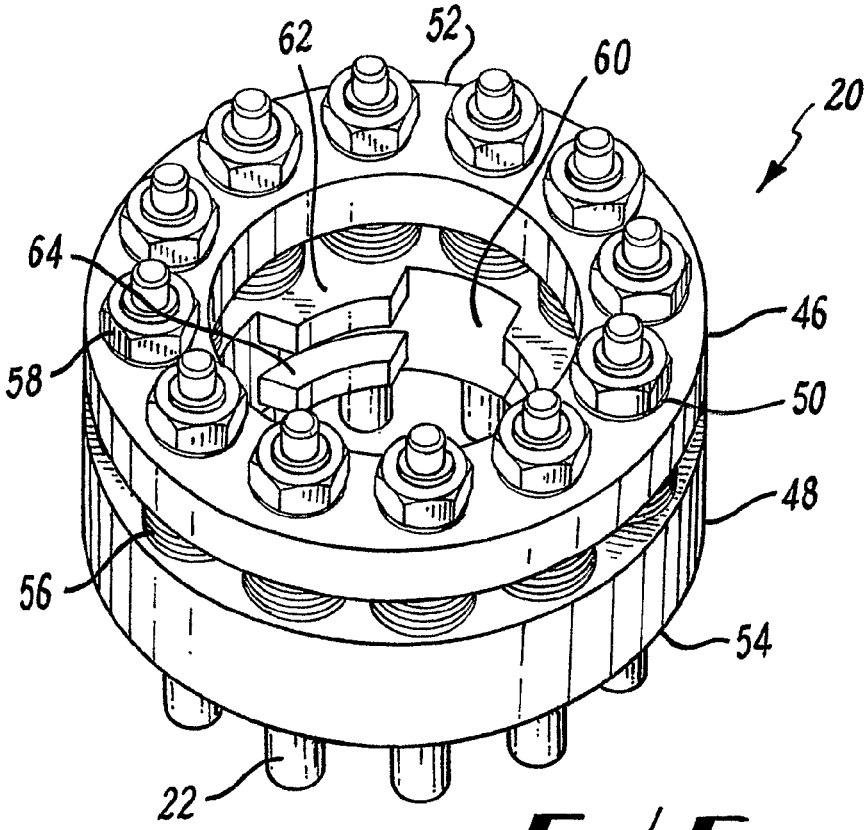
FIG. 5 is a plan view of a compression unit of the valve cap of FIG. 3.

Reference is now made to FIG. 5 of the drawings which illustrates the compression unit 20. Unit 20 comprises two plates or rings 46,48. The upper ring or static ring 46 has twelve apertures 50 arranged equidistantly around its surface which provide longitudinal clearance bores through the ring 46. Although twelve apertures are shown, any number may be selected to suit the dimensions of the ring 46 while providing a sufficient number to effectively spread loading through the unit 20. Thus there is always likely to be more than four apertures 50.

The lower ring or compression ring 48 has matching apertures so that stud rods 22 can be passed from an upper end 52 of the unit to a lower end 54 of the unit. Mounted on each stud bolt 22 is a compression spring 56. The compression springs 56 are sandwiched between the rings 46,48. At the upper end 52, each threaded stud bolt 22 includes a stud nut 58 which can be tightened against the upper end 52 around each aperture 50. Further, on an inner surface 60 there are arranged two rows of lugs 62,64. Each row has four equally spaced lugs circumferentially thereon.

The plug 16 and the compression unit 20 can be considered as a valve plug assembly as together they provide the parts to plug the aperture 12 in the end 14. The docking unit 24 can be considered as an additional part which activates the plug assembly when in position.

Figure 6:
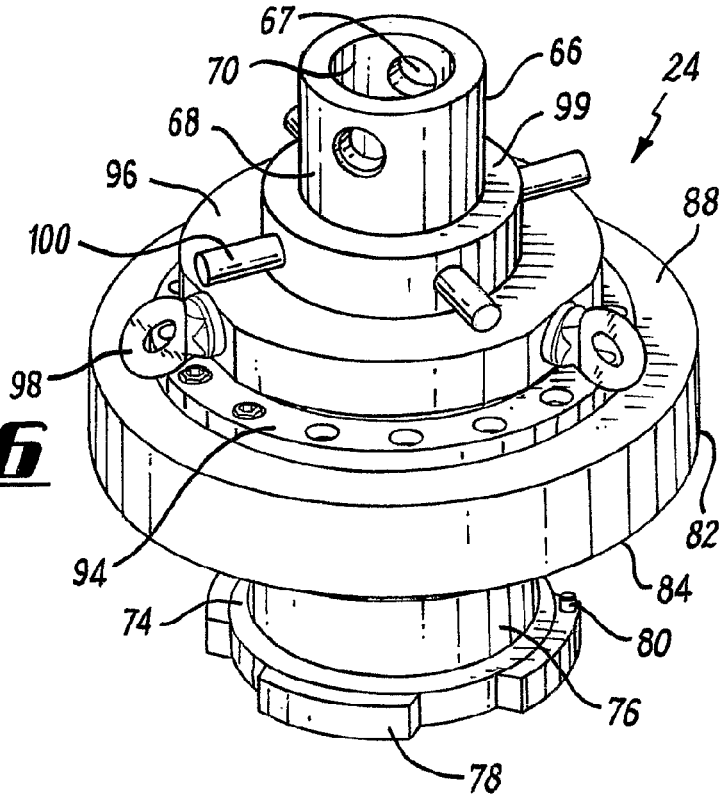
FIG. 6 is a plan view of a docking unit of the valve cap of FIG. 3.

Reference is now made to FIGS. 3 and 6 of the drawings to describe a docking unit 24. The docking unit 24 comprises a number of parts located on a central stem, or active lock stem 66. The stem 66 is a hollow cylindrical body 68 which provides a bore 70 through the unit 24 and its outer surface has threaded portions against which components of the unit can be threaded.

At a lower end 72 of the stem 66 there is a flange referred to as an active lock 74. Active lock 74 is threaded to the stem 66. The lock 74 provides a funnel 76 which flares outwards to provide a surface on which four outwardly facing lugs 78 are equidistantly arranged. On an upper surface of an end of one lug is a peg, referred to as a lock stop 80.

At the upper end of the stem 66 are two oppositely arranged bore holes 67 in the side wall of the body 68. This is to allow a bar to be inserted through the bore holes 67 to assist in turning the stem 66 in the valve cap 10.

Above the active lock 74 is a hydraulic chamber ring 82. The chamber is a ring or flange which is free floating on the stem 66. On a lower surface 84, there is a central recess to provide clearance for the active lock 76 and twelve docking recesses or locating points 86. The locating points 86 fit over each of the stud bolts 22 when the docking unit 24 is landed on the compression unit 20.

On the upper surface 88 of the chamber 82 a cylinder 90 bored into the chamber. Any number of cylinders can be used. Within the cylinder 90 is a hydraulic piston 92 and an access fluid port (not shown) through which hydraulic fluid is fed to the cylinder 90, to impact on a base of the piston 90. Arranged across the top of the chamber 82, over the upper surface 88 is a plate or hydraulic cover 94, which is bolted down and provides a space through which the piston 90 can travel upwards out of the chamber 82. Seals are provided around the piston base to prevent hydraulic fluid from escaping.

The upper end of the piston touches a tensioning disc 96 threaded to the stem 66. When attached the disc 96 cannot move on the thread. On an outer surface of the disc 96 are arranged three lifting eyebolts 98 which are used to lift the docking unit 24 on and off the compression unit 20. A lock nut 99 is provided above the disc 96 and can be screwed down onto the disc 96. Wing bars 100 are provided on the nut 99 to assist in turning it on the stem 66. The wing bars 100 can accept steel tube extensions to further assist in turning the stem 66.

Figure 7:
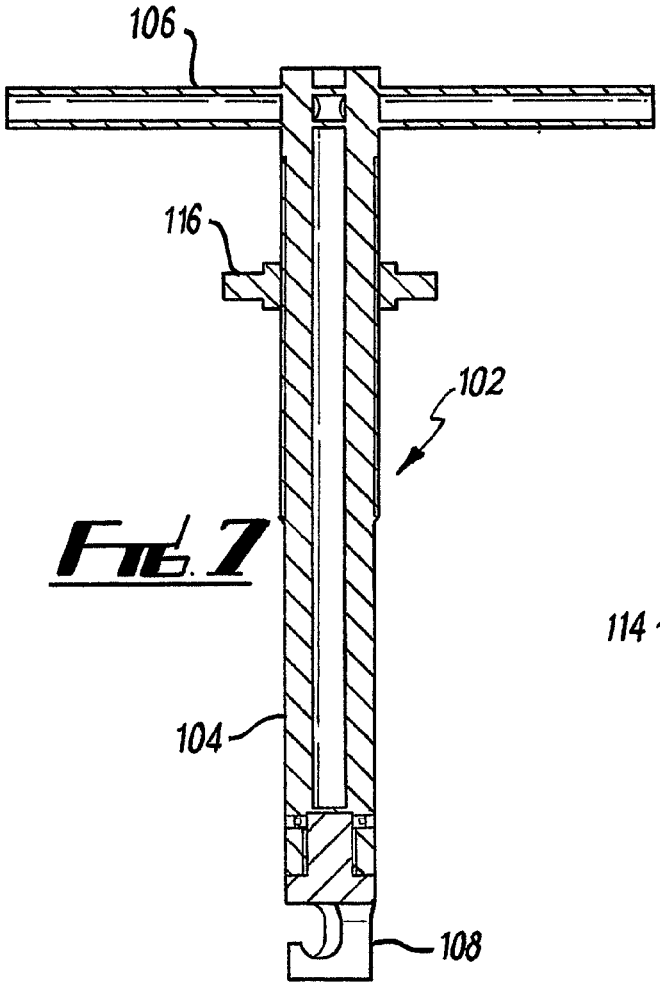
FIG. 7 is a plan view of a turning tool for the valve cap of FIG. 3.
Figure 8:
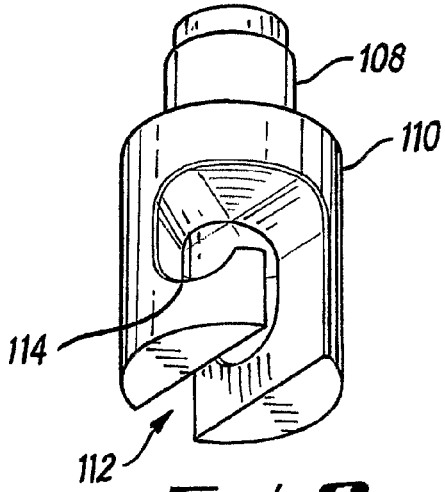
FIG. 8 is an enlarged view of the head of the turning tool of FIG. 7.

A final piece which is needed to operate the valve cap 10 is a turning tool, generally indicated by reference numeral 102. Tool 102 is illustrated in FIGS. 7 and 8. The tool 102 comprises a rod 104 sized to pass through the stem 66. The top of the tool 102 includes a cross bar 106 to assist in turning the tool within the valve cap 10. At the base of the rod 104 is located a puller tip 108, shown in greater detail in FIG. 8. The tip 108 comprises a cylindrical body 110 with an outer diameter sized to fit within the recess 42 of the plug 16. Further an elongate opening 112 across the base of the body 110 rises through the body and turns to form two hooks 114 in the body 110. The opening 112 is off-centre and sized so that the bar 44 in the recess 42 will fit within the opening and rest on the hooks 114 when the tool 102 is turned.

In use, the compression ring 20 is mounted on the fluid end 14 module of a pump. The stud rods 22 are screwed into corresponding fittings on the end 14.

The valve plug 16 should first be well lubricated with high temperature grease and is then lowered through the compression ring 20 and into the aperture 12 in the fluid end 14. Care must be taken to ensure that the lugs 40 of the plug 16 are aligned to travel between the lugs 62,64 of the compression unit 20. In order to rotate the plug 16 to achieve this the turning tool 102 may be used. Tool 102 operates by hooking the bar 42 of the plug 16 on the tip 108 of the tool 102. Any rotation of the tool 102 is then mirrored by the plug 16. The plug 16 is lowered until the lugs 40 abut the wall 18 in the aperture 12. Leakage is prevented between the plug 16 and the end 14 by the tapered plug seal 32 fitted between the periphery of valve plug upper body 26 and valve plug lower body 28. The seal 30 is fitted to prevent pressure loss through the plug 16.

To energize the plug 16, the active docking unit 24 is lifted on top of the compression unit 20 by a lifting device attached to eyebolts 98. Docking unit 24 locating points 86 are securely located over the top of studs 22. The active docking unit 24 will now rest on top of nuts 58. At this point, the lifting device holding active docking unit 24 should be lowered slightly until the lifting slings are just slack.

Stem 66 is now rotated slowly until it is certain that active lock 74 has passed into compression unit 20 with the lugs 80 locating between the lugs 62,64. Active lock 74 is rotated anti-clockwise until lock stop 80 prevents further movement. The tensioning disc 96 is then tightened against the piston 92 to remove any slack by locking in position via rotation of the lock nut 99.

A hydraulic pump is fitted onto a hydraulic connector which feeds the port into the base of the cylinder 90. Pressure is raised to typically 650 Barg. (9,500 PSI). By movement of the piston 92 upwards against a now static disc 96, the hydraulic chamber 82 is forced down against the nuts 58 which will fully compress the compression springs 56.

With the springs 56 in compression, the turning tool 102 is lowered through the bore 70 of the stem 66 and gently rotated until it drops over bar 42. The turning tool is then firmly rotated through 45 degrees clockwise. This causes lugs 64 of the compression unit 20 to abut the teeth of the raised profile in the top surface 36 of the plug 16.

Hydraulic pressure is now released which allows the full force of compression springs 56 to be exerted through compression ring 54 and so impel the plug into the module valve port i.e. aperture 12 against wall 18.

Stem 66 is then rotated 45 degrees anti-clockwise to allow it to be withdrawn from the ring 46. The active docking unit 24 can now be lifted off the compression unit 20, if desired. Alternatively, the docking unit 24 can be left on in order to remove the plug when required for maintenance.

Thus in use, when sealed on the pump, the compression springs 56 are restrained from lifting by the static ring 46 which is restrained by the nuts 58 fitted on the studs 22 which are in turn fitted into the pump module. When pressure is released, the compression springs 56 press very hard down on top 36 of the plug upper body 26. The compression unit 20 therefore provides a very powerful clamping force to prevent the plug 16 from being forced out of the module by the mud/fluid pressure inside the module.

Often, the plug 16 can be removed from the module by hand merely by releasing nuts 58 and pulling the plug 16 from the aperture 12. If, however, the plug proves reluctant to be removed from the module, the active docking unit 24 can be used to remove it.

In this case, the active docking unit 24 is re-attached to the compression unit 20 as described above. The turning tool 102 is then engaged on the bar 42 for the plug 16. The shut-off valve on the hydraulic pump is opened and the tensioning disc 96 is screwed firmly down as far as possible. The lock nut 100 is then firmly screwed down sufficiently to prevent the stem 66 from being able to turn inside the tensioning disc 96. A nut 116 on the turning tool 102 is tightened down against the stem 66 to remove any slack. The hydraulic pressure is then pumped up, typically to 400 Barg. (6,000 PSI), which should readily remove the plug 16.

While the specification has used the relative terms 'up', 'down', 'upper', 'lower' etc., it will be appreciated that with suitable lifting gear, the valve cap may be used in a number of orientations.

The main advantages of the present invention can be summarised as follows:—

1. With an increased number of springs, the resulting powerful spring actuation prevents any tendency for a valve cap to gradually loosen as can happen with screw-type valve caps and increases the actuation available as compared to spring-over-piston valve caps;

2. The active docking unit and its associated hydraulics are only required during maintenance operations when the plug is inserted or removed. At other times, it is stored away from the pump. Only one such unit is thus required, regardless of the number of pumps on an oil rig/platform;

3. The spring clamping force, as a result of hydraulic pressure and a large number of springs, more than overcomes the maximum uplift force exerted on the valve plug including the peak transient mud pressure produced by a reciprocating-type pump;

4. The active docking Unit has the ability to remove sticking valve plugs and sticking valve seats hydraulically without introduction of other equipment;

5. The valve cap allows very fast maintenance of mud-pump valves and valve seats as very little operator judgement is required to set up the valve cap with little manual effort being involved in valve maintenance operations compared with other systems;

6. When the docking unit is removed there is improved security of closed valve caps;

7. All the valve cap parts are readily replaceable in-situ on a pump;

8. In event of a "stuck" plug seal preventing easy removal of plug, the cap screws between the upper and lower plug bodies can be removed to allow the upper body to be removed first, thus permitting quick and easy access to the plug seal.

It will be appreciated that various modifications may be made to the invention herein described without departing from the scope thereof. For example, the valve cap can be scaled according with the increase or decrease in the number of pistons and the number of springs as appropriate. Other types of springs could also be used.

The invention claimed is:

1. A valve cap for sealing an aperture in a pump, the cap comprising:

a valve plug for locating against a wall of the aperture, the plug including a first engaging means;

a compression unit fastened to said pump, the compression unit including a plurality of springs to apply a compressive load upon the plug and second engaging means;

a docking unit for landing on the compression unit, the docking unit including one or more pistons to apply a compressive load upon said springs and third engaging means;

wherein said third engaging means interlocks by rotation with respect to said second engaging means to lock said docking unit to said compression unit; and wherein said first engaging means sequentially interlocks by rotation with respect to said second engaging means to selectively lock said plug to said compression unit and seal said plug against said aperture.

2. A valve cap as claimed in claim 1, wherein said first, second or third engaging means comprises one or more keyed profiles.

3. A valve cap as claimed in claim 1, wherein the first and third engaging means comprise cogs.

4. A valve cap as claimed in claim 1, wherein the second engaging means comprises a cylindrical surface on which are arranged internally facing teeth.

5. A valve cap as claimed in claim 4, wherein the first and third engaging means comprise cogs and wherein the internally facing teeth match teeth on the cogs.

6. A valve cap as claimed in claim 5, wherein two rows of teeth are provided on the compression unit such that a cog can pass one row of teeth and by rotation be interlocked between the rows of teeth.

7. A valve cap as claimed in claim 1, wherein the plug includes a first seal arranged around an outer periphery of the plug.

8. A valve cap as claimed in claim 7 wherein the first seal is tapered.

9. A valve cap as claimed in claim 7, wherein the plug can be passed through the compression unit by rotation of the first engaging means away from the second engaging means.

10. A valve cap as claimed in claim 1, including an elongate member arranged parallel to a base of the plug.

11. A valve cap as claimed in claim 10, wherein the elongate member is adapted to be used to engage a tool for turning the plug within the aperture.

12. A valve cap as claimed in claim 1, wherein the compression unit further comprises an upper plate and a lower plate, the plates sandwiching the plurality of springs.

13. A valve cap for sealing an aperture in a pump, the cap comprising:

a valve plug for locating against a wall of the aperture, the plug including a first engaging means;

a compression unit fastened to said pump, the compression unit including a plurality of springs to apply a compressive load upon the plug and second engaging means;

a docking unit for landing on the compression unit, the docking unit including one or more pistons to apply a compressive load upon said springs and third engaging means;

wherein said first and third engaging means sequentially interlock with said second engaging means to lock said plug to said compression unit and seal said plug against said aperture; and wherein the compression unit further comprises an upper plate and a lower plate, the plates sandwiching the plurality of springs and fastening means provided through each plate to attach the plates to the pump.

14. A valve cap as claimed in claim 13, wherein the fastening means are stud rods, each passing through a spring and including a retaining nut at one end.

15. A valve cap as claimed in claim 12, wherein the lower plate comprises the second engaging means.

16. A valve cap for sealing an aperture in a pump, the cap comprising:

a valve plug for locating against a wall of the aperture, the plug including a first engaging means;

a compression unit fastened to said pump, the compression unit including a plurality of springs to apply a compressive load upon the plug and second engaging means;

a docking unit for landing on the compression unit, the docking unit including one or more pistons to apply a compressive load upon said springs and third engaging means;

wherein said first and third engaging means sequentially interlock with said second engaging means to lock said plug to said compression unit and seal said plug against said aperture; and wherein the docking unit further comprises a stem, the stem having a longitudinal bore therethrough for access to the plug, a locating plate including a plurality of recesses for locating on the fastening means and one or more cylinders, the/each cylinder including a piston, the piston extending from the cylinder to impact a tensioning disc located on the stem.

17. A valve cap as claimed in claim 16, wherein the third engaging means is located at a lower end of the stem.

18. A valve cap as claimed in claim 16, wherein a locking nut is located on the stem adjacent the tensioning disc.

19. A valve cap as claimed in claim 16, having one or more ports through which hydraulic fluid can enter the one or more cylinders.

20. A valve cap as claimed in claim 16, wherein an upper end of the stem includes a pair of radially aligned apertures through which a bar may be passed to rotate the stem.

21. A valve cap as claimed in claim 1, further comprising a locking tool, the locking tool adapted to be used to interlock the first engaging means to the second engaging means.

22. A valve cap as claimed in claim 21, wherein the docking unit further comprises a stem, the stem having a longitudinal bore therethrough for access to the plug, a locating plate including a plurality of recesses for locating on the fastening means and one or more cylinders, the/each cylinder including a piston, the piston extending from the cylinder to impact a tensioning disc located on the stem and wherein the locking tool comprises a barrel suitable for locating through the stem and a hook arranged to engage the elongate member.

23. A plugging assembly for use in a valve cap to provide a seal at an aperture in a pump, the assembly comprising:

a valve plug for locating against a wall of the aperture, the plug including a first engaging means;

a compression unit fastened to said pump, the compression unit including a plurality of springs to apply a compressive load upon the plug and second engaging means;

wherein said first and engaging means is rotatable with respect to said second engaging means to pass the plug through the compression unit; and wherein said first and second engaging means interlock when the springs are in full compression and remain locked when the springs are released.

24. A plugging assembly as claimed in claim 23, wherein at least one of said first or second engaging means comprises one or more keyed profiles.

25. A plugging assembly as claimed in claim 23, wherein the first engaging means comprise cogs.

26. A plugging assembly as claimed in claim 23, wherein the second engaging means comprises a cylindrical surface on which is arranged internally facing teeth.

27. A plugging assembly as claimed in claim 26, wherein the first engaging means comprise cogs and wherein the internally facing teeth match teeth on the cogs.

28. A plugging assembly as claimed in claim 26, wherein the first engaging means comprise cogs and wherein two rows of teeth are provided on the compression unit such that a cog can pass one row of teeth and by rotation be interlocked between the rows of teeth.

29. A plugging assembly as claimed in claim 23, wherein the plug further comprises upper and lower members.

30. A plugging assembly as claimed in claim 29, wherein the members are joined together.

31. A plugging assembly as claimed in claim 23, wherein the plug includes a first seal arranged around an outer surface of the plug.

32. A plugging assembly as claimed in claim 31, wherein the first seal is tapered.

33. A plugging assembly as claimed in claim 31, wherein the plug further comprises upper and lower members and wherein there is a second seal between the members.

34. A plugging assembly as claimed in claim 23, including an elongate member arranged parallel to a base of the plug.

35. A plugging assembly as claimed in claim 34, wherein the elongate member is adapted to be used to engage a tool for turning the plug within the aperture.

36. A plugging assembly as claimed in claim 23, wherein the compression unit further comprises an upper plate and a lower plate, the plates sandwiching the plurality of springs and the upper plate including a plurality of surfaces on which a compressive load can be applied.

37. A plugging assembly as claimed in claim 36, wherein fastening means is provided through each plate to attach the plates to the pump.

38. A plugging assembly as claimed in claim 37, wherein the fastening means are stud rods, each passing through a spring and including a retaining nut at one end.

39. A plugging assembly as claimed in claim 36, wherein the lower plate comprises the second engaging means.

40. A docking unit for use with a plugging assembly for sealing an aperture in a pump, the unit comprising:

a plurality of surfaces for landing on a compression unit of a plugging assembly;

one or more pistons to apply a compressive load upon said compression unit and third engaging means;

wherein said third engaging means is adapted to selectively interlock by rotation with respect to said second engaging means of said compression unit during compression of said compression unit or disengage from said second engaging means for removal of the docking unit from the compression unit while maintaining compression of the plugging assembly.

41. A docking unit as claimed in claim 40, wherein at least one of said second or third engaging means comprises one or more keyed profiles.

42. A docking unit as claimed in claim 40, wherein the third engaging means comprise cogs.

43. A docking unit as claimed in claim 40, wherein the second engaging means comprises a cylindrical surface on which is arranged internally facing teeth.

44. A docking unit as claimed in claim 43, wherein the third engaging means comprise cogs and wherein the internally facing teeth match teeth on the cogs.

45. A docking unit as claimed in claim 44, wherein two rows of teeth are provided on the compression unit such that a cog can pass one row of teeth and by rotation be interlocked between the rows of teeth.

46. A docking unit for use with a plugging assembly for sealing an aperture in a pump, the unit comprising:

a plurality of surfaces for landing on a compression unit of a plugging assembly;

one or more pistons to apply a compressive load upon said compression unit and third engaging means;

wherein said third engaging means interlocks with second engaging means of said compression unit during compression of said unit; and a stem, the stem having a longitudinal bore therethrough for access to the plug, a locating plate including a plurality of recesses for locating on the fastening means and one or more cylinders, the/each cylinder including a piston, the piston extending from the cylinder to impact a tensioning disc located on the stem.

47. A docking unit as claimed in claim 46, wherein the third engaging means is located at a lower end of the stem.

48. A docking unit as claimed in claim 46, wherein a locking nut is located on the stem adjacent the tensioning disc.

49. A docking unit as claimed in claim 46, wherein there are one or more ports through which hydraulic fluid can enter the one or more cylinders.

50. A docking unit as claimed in claim 46, wherein an upper end of the stem includes a pair of radially aligned apertures through which a bar may be passed to rotate the stem.

51. A docking unit for use with a plugging assembly for sealing an aperture in a pump, the unit comprising:

a plurality of surfaces for landing on a compression unit of a plugging assembly;

one or more pistons to apply a compressive load upon said compression unit and third engaging means;

wherein said third engaging means interlocks with second engaging means of said compression unit during compression of said docking unit; and a locking tool, the locking tool adapted to be used to interlock a first engaging means of the plugging assembly to the second engaging means.

52. A docking unit as claimed in claim 51, further comprising a stem, the stem having a longitudinal bore therethrough for access to the plug, a locating plate including a plurality of recesses for locating on the fastening means and one or more cylinders, the/each cylinder including a piston, the piston extending from the cylinder to impact a tensioning disc located on the stem and wherein the locking tool comprises a barrel suitable for locating through the stem and a hook arranged to engage the elongate member.

53. A method of sealing an aperture in a pump, the method comprising the steps:

fixing a compression unit to an end face of the pump around the aperture;

passing a valve plug through the compression unit to locate the valve plug against a wall of the aperture;

landing a docking unit on the compression unit;

by rotating a portion of the docking unit, locking the docking unit to the compression unit;

applying a compressive load from the docking unit on the compression unit to compress a plurality of springs within the compression unit;

tightening a plate over the compressed springs;

locking the valve plug to the compression unit by rotating the valve plug; and removing the compressive load applied by the docking unit to release the springs and seal the plug against the aperture.

54. A method as claimed in claim 53, wherein the valve plug comprises a first engaging means, the compression unit comprises a second engaging means and one or more pistons and the docking unit comprises a third engaging means; wherein the rotation of the valve plug locks the first engaging means of the valve plug to the second engaging means of the compression unit, and wherein rotation of a stem in the docking unit selectively locks the third engaging means of the docking unit to the second engaging means of the compression unit, or unlocks the third engaging means of the docking unit from the second engaging means of the compression unit.

55. A valve cap for sealing an aperture in a pump, the valve cap comprising:

a valve plug for locating against a wall of the aperture, the plug including a first cog;

a compression unit for fastening to the pump, the compression unit including a keyed profile to interlock the first cog and including a plurality of springs to apply a compressive load upon the plug;

a docking unit for landing on the compression unit, the docking unit including a second cog to interlock the keyed profile of the compression unit and including one or more pistons to apply a compressive load upon the springs.

* * * * *